US009216855B2

(12) United States Patent
King et al.

(10) Patent No.: US 9,216,855 B2
(45) Date of Patent: Dec. 22, 2015

(54) VENTED LID FOR CART

(71) Applicant: Rehrig Pacific Company, Los Angeles, CA (US)

(72) Inventors: Philip A King, Sugar Hill, GA (US); Jon P Hassell, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/281,185

(22) Filed: May 19, 2014

(65) Prior Publication Data

US 2014/0339233 A1 Nov. 20, 2014

Related U.S. Application Data

(60) Provisional application No. 61/824,390, filed on May 17, 2013.

(51) Int. Cl.
*B65F 1/16* (2006.01)

(52) U.S. Cl.
CPC ..... *B65F 1/16* (2013.01); *B65F 2210/181* (2013.01)

(58) Field of Classification Search
CPC ..... B65D 51/1611; B65D 51/1605; B65D 51/16; B65D 43/262; B65D 43/26; B65F 2210/181; B65F 1/1421; B65F 1/1623; B65F 1/163; B65F 1/16
USPC ..... 220/367.1, 908, 908.1, 495.06, 495.04, 220/264, 263, 262; D34/9, 8, 7

See application file for complete search history.

(56) References Cited

U.S. PATENT DOCUMENTS

| | | | | | |
|---|---|---|---|---|---|
| 4,325,492 | A | * | 4/1982 | Kunze | 220/831 |
| 5,031,796 | A | * | 7/1991 | Schafer et al. | 220/571 |
| 5,088,750 | A | * | 2/1992 | Beese et al. | 280/47.26 |
| 5,217,135 | A | * | 6/1993 | Smith et al. | 220/831 |
| D398,120 | S | * | 9/1998 | Rehrig et al. | D34/5 |
| 5,899,468 | A | * | 5/1999 | Apps et al. | 280/47.26 |

FOREIGN PATENT DOCUMENTS

EP 386568 A1 * 2/1990 ..... B65F 1/14

OTHER PUBLICATIONS

Translation of EP386568 (Schafer et al.) Feb. 26, 1990, Paragraph 37.*

* cited by examiner

*Primary Examiner* — Robert J Hicks
(74) *Attorney, Agent, or Firm* — Carlson, Gaskey & Olds LLC

(57) ABSTRACT

A lid for a container includes an upper panel portion and at least one connector extending rearward of the upper panel portion. A lip extends downward of the upper panel portion. A plurality of vent openings are molded into the lid. Some of the vent openings may be formed through the lip. Some of the vent openings may be formed through a substantially vertical front surface of the lid below a flange to prevent rain from entering the openings.

14 Claims, 4 Drawing Sheets

VENTED LID FOR CART

BACKGROUND

Roll-out carts for waste, recycling or compost may include a lid with vent openings. One known cart lid includes an opening formed through the lid. A separate vent piece is attached over the opening.

SUMMARY

A lid for a container includes an upper panel portion and at least one connector extending rearward of the upper panel portion. A lip extends downward of the upper panel portion. A plurality of vent openings are molded into the lid.

The vent openings are arranged in several locations to provide ventilation but without permitting much rain water into the container. For example, the vent openings may be formed on substantially vertical surfaces. For another example, flanges may be formed above the vent openings to inhibit rain from entering the container through the openings.

DETAILED DESCRIPTION OF A PREFERRED EMBODIMENT

A lid 10 is provided for a rollout cart 8 or other waste container. The lid 10 includes an upper panel portion 12 and hinge connectors 14 protruding rearward. The hinge connectors 14 pivotably connect to the handle of the rollout cart 8.

Figure 2:
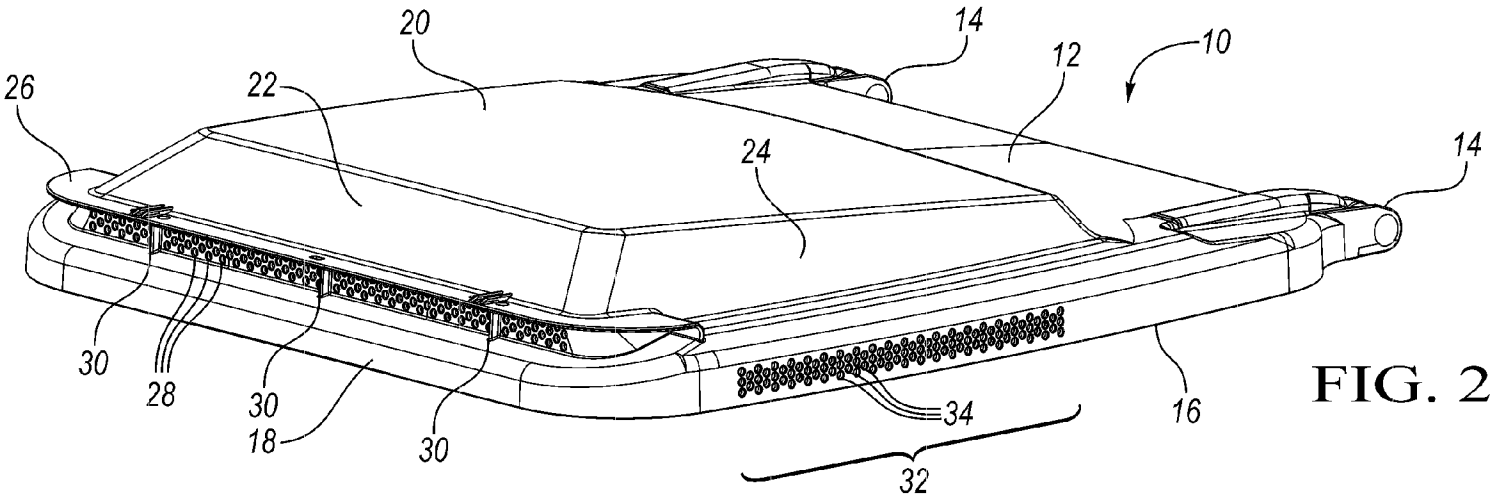
FIG. 2 is a front upper perspective view of the lid of FIG. 1.

FIG. 2 is a perspective view of the lid 10. Side wall portions 16 extend downward from side edges of the panel portion 12. A front wall portion 18 extends downward from a front edge of the panel portion 12. The panel portion 12 includes a raised portion 20 having an upper surface, a sloped front surface 22 and sloped side surfaces 24. A front flange 26 extends forwardly from the sloped front surface 22. The front flange 26 is slanted back toward the sloped front surface 22. Below the front flange 26 a plurality of front ventilation apertures 28 are formed in the sloped front surface 22. A plurality of ribs 30 may reinforce the front flange 26. A side ventilation area 32 is formed in each side wall portion 16 and includes a plurality of side ventilation apertures 34 through each side wall portion 16.

Figure 3:
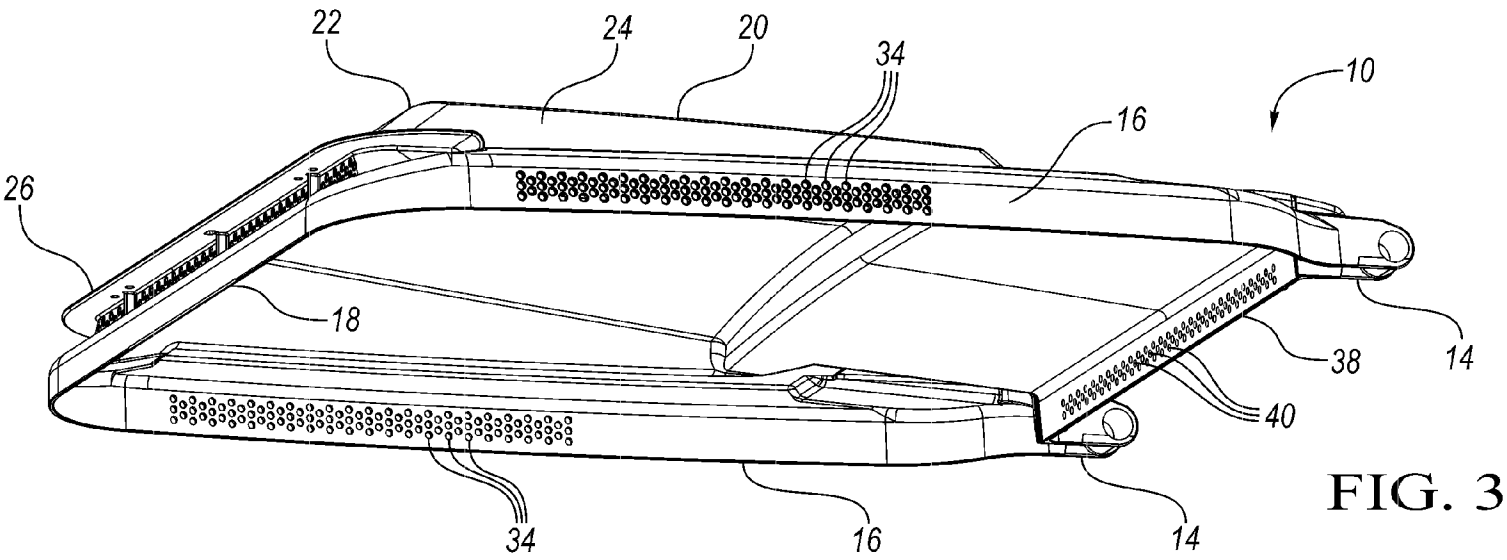
FIG. 3 is a bottom perspective view of the lid.

As can also be seen in FIG. 3, a rear wall portion 38 extends downward from a rear edge of the panel portion 12. A plurality of rear ventilation apertures 40 are formed through the rear wall portion 38. Together the side wall portions 16, the front wall portion 18 and the rear wall portion 38 form a lip extending downward of the upper panel portion 12.

Figure 4:
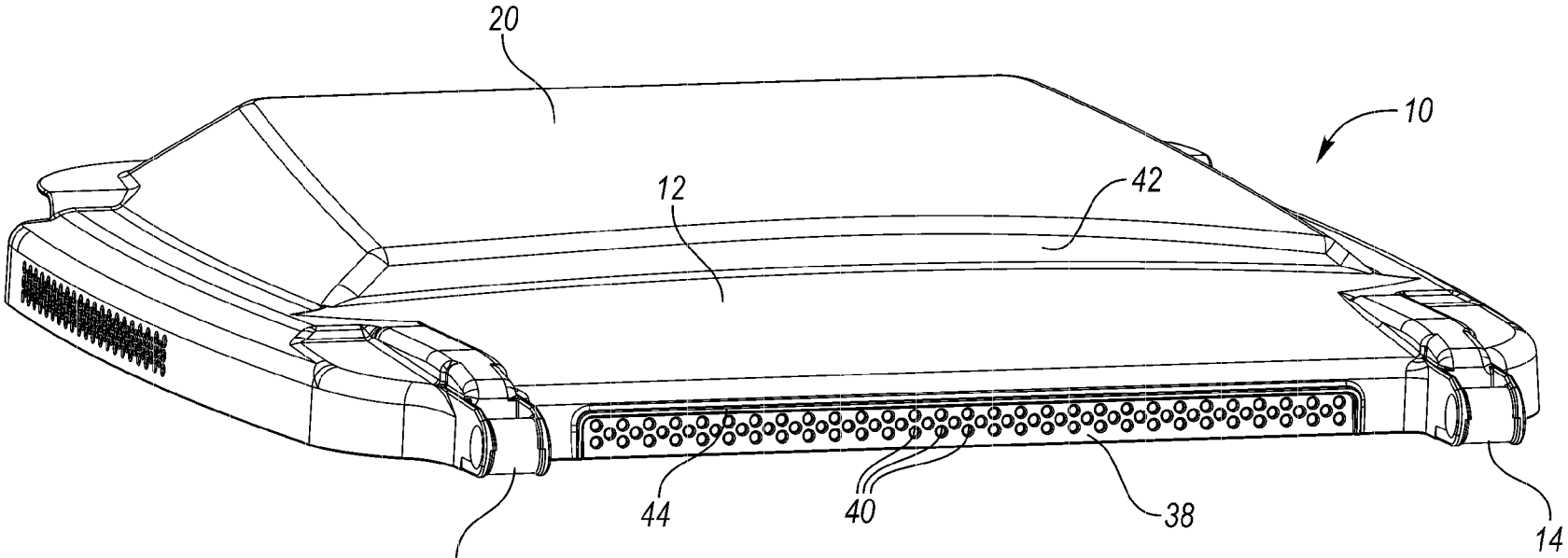
FIG. 4 is a rear perspective view of the lid.
Figure 5:
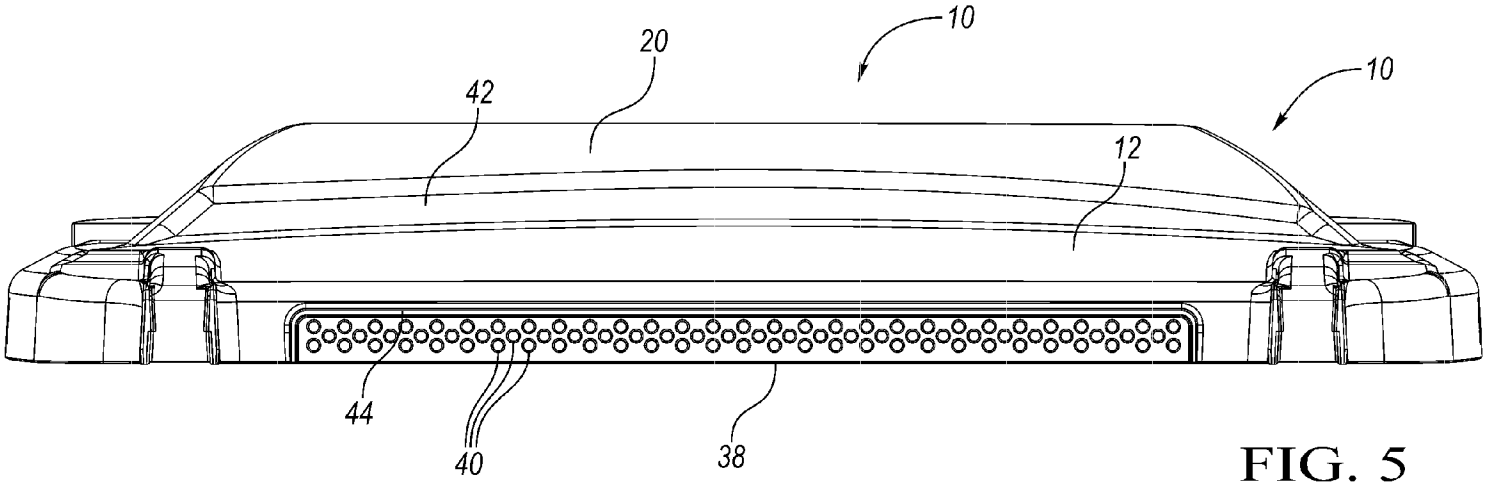
FIG. 5 is a rear view of the lid.

FIG. 4 is a rear perspective view of the lid 10. A rear sloped surface 42 is formed between the raised portion 20 and a rear portion of the panel portion 12. A rib 44 extends horizontally above the plurality of rear ventilation apertures 40 in the rear wall portion 38 and then vertically down on either side of the area of rear ventilation apertures 40. FIG. 5 is a rear view of the lid 10.

Figure 6:
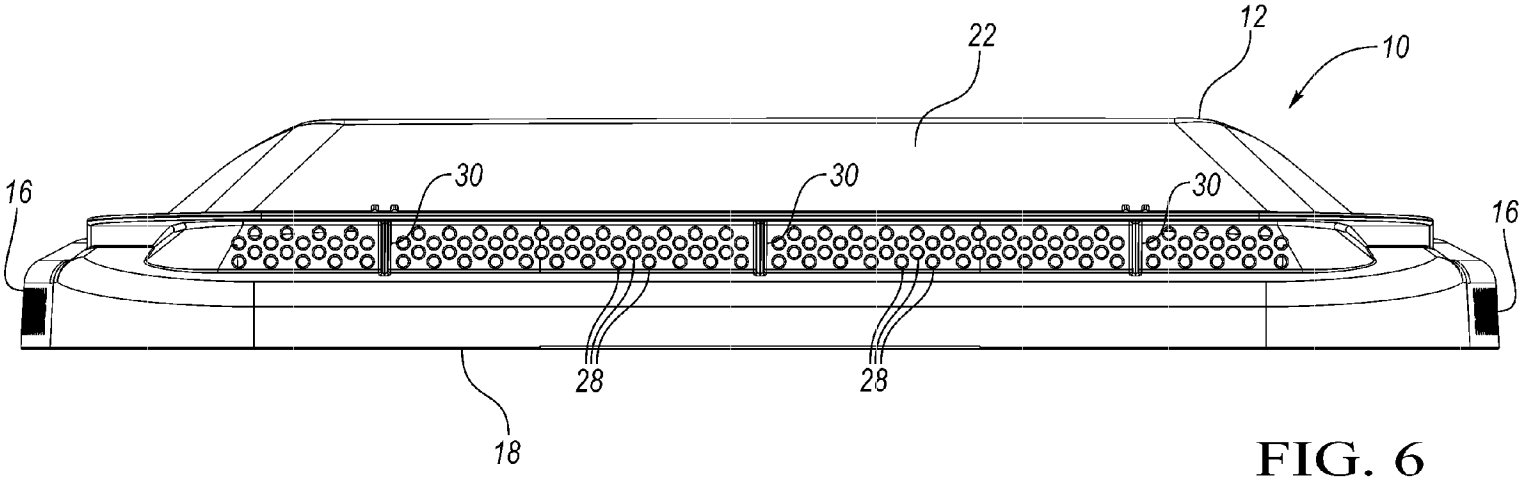
FIG. 6 is a front view of the lid.

FIG. 6 is a front view of the lid 10. As shown, the plurality of front ventilation apertures 28 are formed below the front flange 26 through the sloped front surface 22 of the panel portion 12. The area of the sloped front surface 22 through which the front ventilation apertures 28 are formed may be significantly steeper than the remainder of the sloped front surface 22, as shown in FIGS. 2 and 3.

Figure 1:
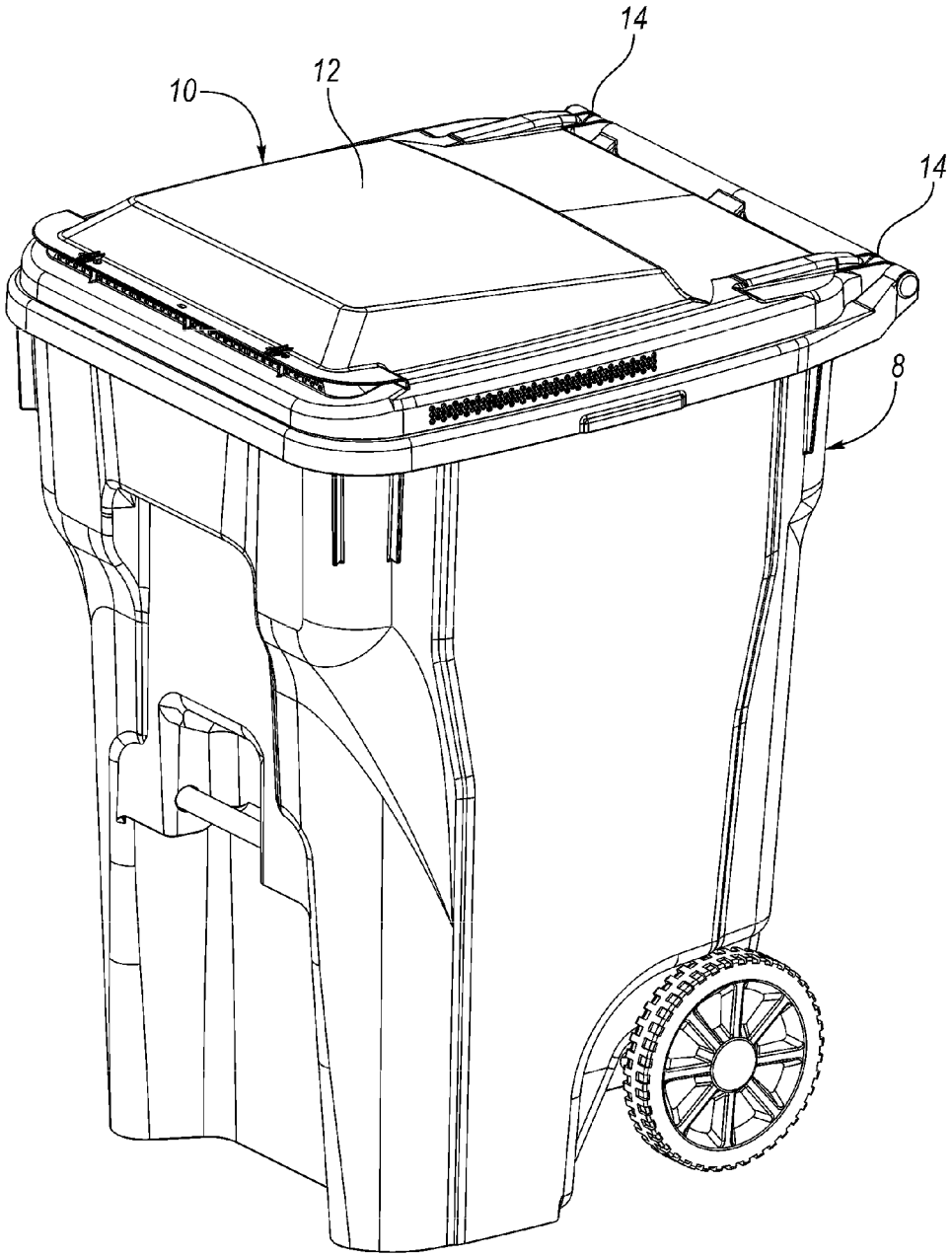
FIG. 1 is a perspective view of a lid on a roll-out cart.

The lid 10 provides improved ventilation to the cart 8 (FIG. 1). The ventilation apertures 28, 34, 40 are molded integrally into the lid 10, which is molded as a single piece of plastic. The front flange 26 is integrally molded with the remainder of the lid 10 and shields the front ventilation apertures 28 from rain, so that the container 8 does not fill with water in the rain. The side ventilation apertures 34 will not provide much rainwater into the container 8 because they are formed on a vertical side surface, side wall portion 16, while most of the water falling on the lid 10 will drain toward the rear of the lid 10 via the raised portion 20, rear sloped surface 42. Referring to FIG. 4, the rib 44 will deflect much of the rainwater washing off the back of the lid 10 around the rear ventilation openings 40.

Thus the lid 10 is less expensive to manufacture, requires less labor to manufacture, more durable, provides better ventilation and limits the amount of rain that enters the container 8. The lid may be injection molded as a single piece of plastic, such as polypropylene, polyethylene, HDPE, or other suitable material.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A lid for a container comprising:
an upper panel portion;
at least one connector extending rearward of the upper panel portion;
a lip extending downward of the upper panel portion, the lip including a rear wall portion extending downward at a rear edge of the lid, wherein a plurality of vent openings are molded into the lid and wherein the plurality of vent openings include a first set of openings formed through the rear wall portion of the lip, the plurality of vent openings include a second set of openings through a front surface of the lid;
a flange above the first set of openings through the rear wall portion; and
a front flange above the second set of openings to reduce rain entering the second set of openings, wherein the front flange is integrally molded with the upper panel portion.

2. The lid of claim 1 wherein the lip includes side wall portions extending down at side edges of the lid and a third set of openings are formed through the side wall portions.

3. The lid of claim 1 wherein the lid is integrally molded as a single piece of plastic.

4. The lid of claim 1 wherein the front flange is slanted rearward to drain rain away from the second set of openings.

5. The lid of claim 4 wherein the second set of openings are formed above the lip.

6. The lid of claim 5 wherein the lid is integrally molded as a single piece of plastic.

7. The lid of claim 6 wherein the at least one connector is pivotably secured proximate an upper end of a container.

8. The lid and container of claim 7 wherein the container is a roll-out cart.

9. A lid for a container comprising:
an upper panel portion;

at least one connector extending rearward of the upper panel portion;

a lip extending downward of the upper panel portion, wherein a plurality of vent openings are molded into the lip; and a flange above the plurality of vent openings to reduce rain entering the vent openings, wherein the flange is integrally molded with the upper panel portion and the lip.

10. The lid of claim 9 wherein the flange is slanted to drain rain away from the plurality of vent openings.

11. The lid of claim 10 wherein the plurality of vent openings are formed through a front surface of the lid.

12. The lid of claim 11 wherein the plurality of vent openings are formed above the lip.

13. A lid for a container comprising:

an upper panel portion;

a substantially vertical surface having a plurality of vent openings molded therethrough, wherein the lid, including the upper panel portion and the substantially vertical surface, is integrally molded as a single piece of plastic; and a flange above the plurality of vent openings to reduce rain entering the vent openings, wherein the flange is slanted to drain rain away from the plurality of vent openings, wherein the flange is integrally molded with the upper panel portion.

14. The lid of claim 13 wherein the substantially vertical surface is a front surface of the lid.

* * * * *